US008038483B2

(12) United States Patent
Souda

(10) Patent No.: US 8,038,483 B2
(45) Date of Patent: Oct. 18, 2011

(54) IMAGE FORMING APPARATUS AND ELECTRODE MEMBER FOR THE SAME

(75) Inventor: Makoto Souda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/729,176

(22) Filed: Mar. 22, 2010

(65) Prior Publication Data

US 2011/0065336 A1 Mar. 17, 2011

(30) Foreign Application Priority Data

Sep. 17, 2009 (JP) ..... 2009-215293

(51) Int. Cl.
*H01R 13/24* (2006.01)

(52) U.S. Cl. ..... 439/700

(58) Field of Classification Search ..... 439/700, 439/17

See application file for complete search history.

(56) References Cited

U.S. PATENT DOCUMENTS 4,029,375 A * 6/1977 Gabrielian ..... 439/66
2003/0176113 A1* 9/2003 Sasaki ..... 439/700

FOREIGN PATENT DOCUMENTS

JP S62-041132 U 3/1987
JP H11-249362 A 9/1999
JP 3678905 B2 8/2005
JP 2007-071999 A 3/2007

OTHER PUBLICATIONS

Japan Patent Office, Notification of Reason for Refusal for Japanese Patent Application No. 2009-215293 (counterpart to above-captioned patent application), dispatched Jun. 21, 2011.

* cited by examiner

*Primary Examiner* — Phuong Dinh
(74) *Attorney, Agent, or Firm* — Baker Botts L.L.P.

(57) ABSTRACT

An image forming apparatus includes: a first electrode including a spring portion extending in an axial direction and an annular contact portion extending from a first side in the axial direction; a first frame including a through hole, through which the annular contact portion protrudes; and a second frame, which is relatively movable to the first frame along an elongated direction of the annular contact portion at a further extension of the first side in the axial direction, and which includes a second electrode electrically connectable with the annular contact portion. A diameter of the annular contact portion is larger than that of the spring portion. The first frame includes a lock portion that locks the annular contact portion to place a center of the annular contact portion on a second side, which is opposite to the first side, in the axial direction from an end of the through hole.

16 Claims, 10 Drawing Sheets

FIG. 6A
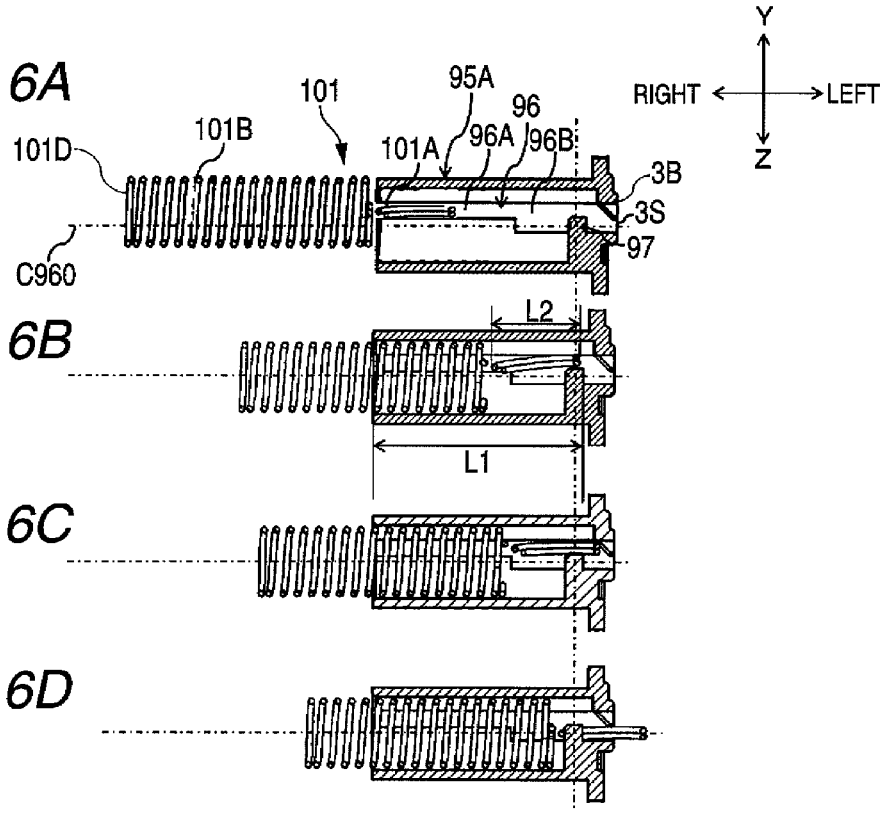
FIG. 6B
FIG. 6C
FIG. 6D
FIG. 7
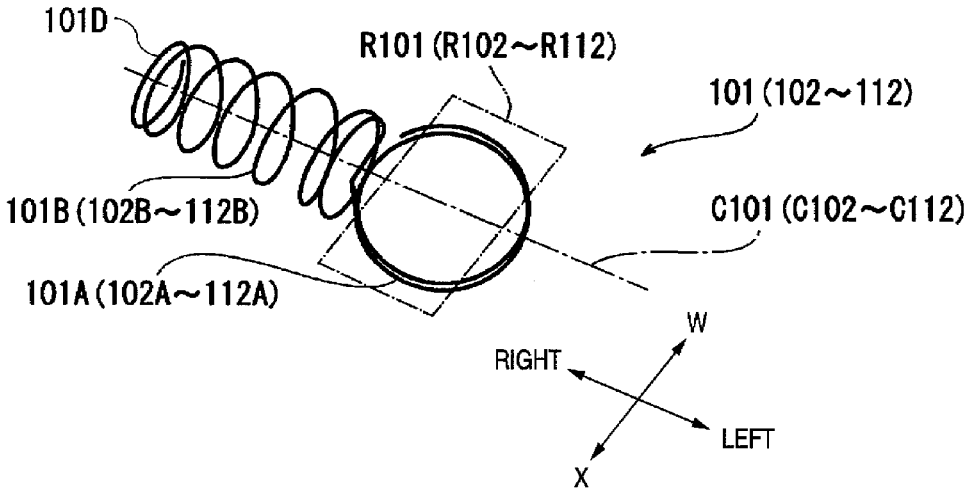

IMAGE FORMING APPARATUS AND ELECTRODE MEMBER FOR THE SAME

CROSS-REFERENCE TO RELATED APPLICATIONS

This application claims priority from Japanese Patent Application No. 2009-215293 filed on Sep. 17, 2009, the entire subject matter of which is incorporated herein by reference.

TECHNICAL FIELD

The present invention relates to an image forming apparatus and an electrode member attached to the image forming apparatus.

BACKGROUND

In an electrophotographic image forming apparatus, there has been proposed a known image forming apparatus including a process cartridge, which includes a photosensitive drum, a charger and the like, and which is detachably attached to a body housing.

The body housing includes an electrode spring.

The electrode spring includes a spring portion and a contact portion. The spring portion has a cylindrically coiled shape. The contact portion has an annular shape and is formed integrally with the spring portion by bending the spring portion. The diameter of the contact portion is substantially the same as that of the spring portion. The distal end of the contact portion protrudes, in the body housing, from a through hole formed in the frame into the space where the process cartridge is attached.

The process cartridge includes an electrode portion. When the process cartridge is attached to the body housing, the distal end of the contact portion, which protrudes from the through hole, and the electrode portion abut on each other. According thereto, the contact portion and the electrode portion are electrically connected.

SUMMARY

Illustrative aspects of the invention provide an image forming apparatus and an electrode member that secures electrical connection between electrodes.

BRIEF DESCRIPTION OF THE DRAWINGS

Illustrative aspects of the invention will be described in detail with reference to the following figures wherein:

FIGS. 6A to 6D are explanatory views showing operations of installing the first electrode to the frame member;

FIG. 7 is a perspective view of the first electrode;

DETAILED DESCRIPTION

General Overview

Figure 1:
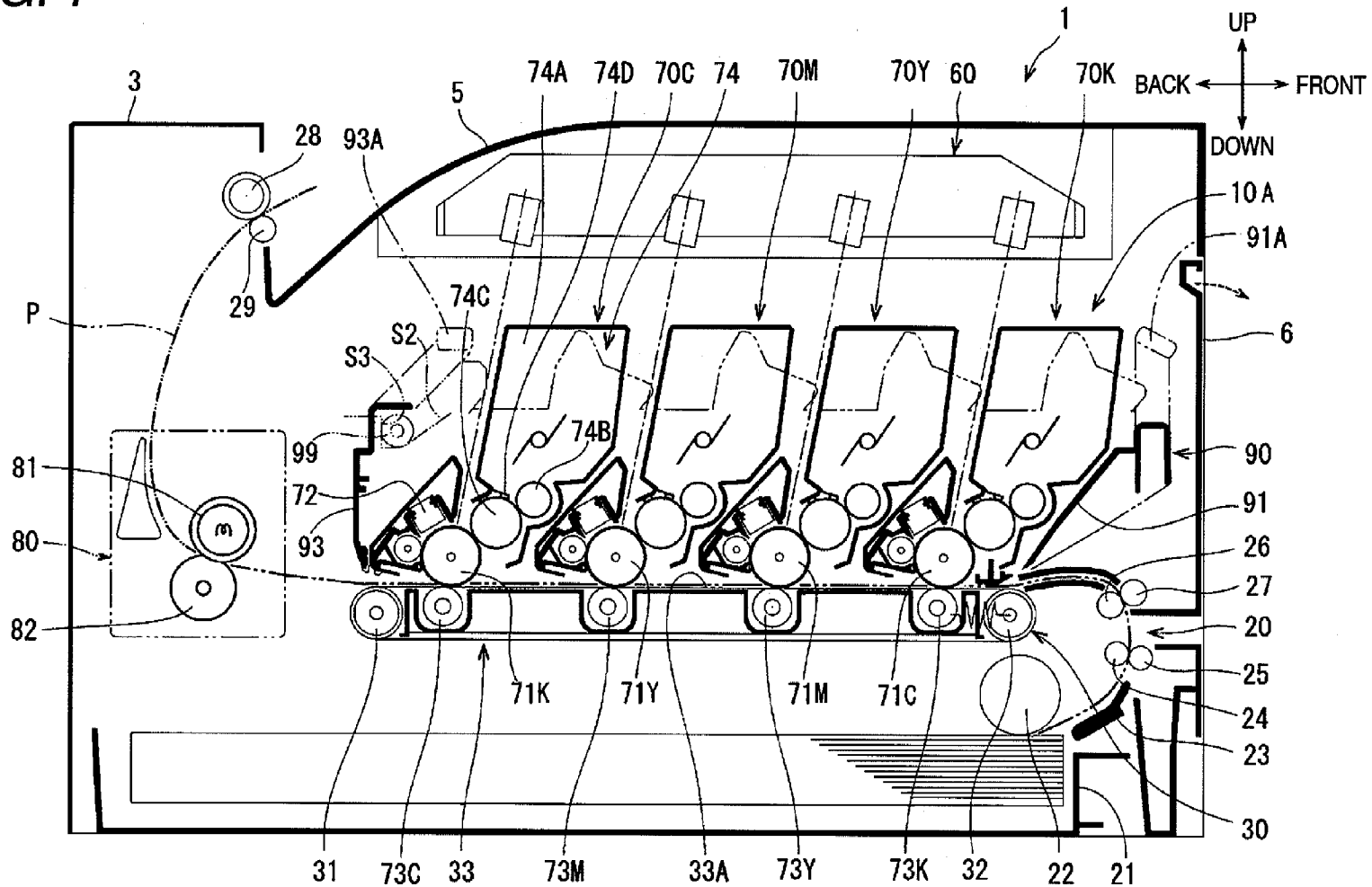
FIG. 1 is a schematic cross-sectional view of an image forming apparatus according to the invention.

In order to establish stable electrical connection between the contact portion and the electrode portion, the distal end of the contact portion is required to largely protrude from the through hole.

However, in the known image forming apparatus, if the contact portion is largely protruded from the through hole, a part of the contact portion protruding from the through hole may be caught by the cartridge. Further, in the known image forming apparatus, when the process cartridge is attached to the body housing, a shape of the contact portion causes the electrode portion difficult to smoothly abut on the contact portion. Thus, the electrical connection between the electrode portion on the process cartridge side and the electrode portion on the body housing side may not be stable.

Accordingly, illustrative aspects of the invention provide an image forming apparatus and an electrode member that facilitates electrical connection between electrodes.

According to a first illustrative aspect of the invention, there is provided an image forming apparatus comprising: a first electrode comprising: a spring portion, which has a cylindrically coiled shape, and which extends in an axial direction; and an annular contact portion, which extends from a first side in the axial direction of the spring portion, and which has an elongated shape viewed from the axial direction; a first frame comprising a through hole, which passes through the first frame in the axial direction, and through which a part of the annular contact portion protrudes toward an extension of the first side in the axial direction; and a second frame, which is relatively movable to the first frame along an elongated direction of the annular contact portion at a further extension of the first side in the axial direction, and which comprises a second electrode that is electrically connectable with the annular contact portion, wherein a diameter of the annular contact portion is larger than a diameter of the spring portion, and wherein the first frame comprises a lock portion that locks the annular contact portion to place a center of the annular contact portion on a second side, which is opposite to the first side, in the axial direction from an end of the through hole.

According thereto, the diameter of the contact portion is larger than the diameter of the spring portion and the lock portion locks the center of the circle of the contact portion so as to be located on another side, in the axial direction, of the end of the through hole on one side in the axial direction. Therefore, when the second frame is moved, the second electrode can be made to smoothly abut on the contact portion even if the contact portion largely protrudes. Accordingly, electrical connection can be facilitated between the first electrode and the second electrode.

According to a second illustrative aspect of the invention, there is provided an image forming apparatus comprising: a first electrode comprising: a spring portion, which has a cylindrically coiled shape, and which extends in an axial direction; and a contact portion, which extends from a first side in the axial direction of the spring portion, which has an elongated shape viewed from the axial direction, and which comprises an arch-shaped portion at an end in the axial direction; a first frame comprising a through hole, which passes through the first frame in the axial direction, and through which the arch-shaped portion protrudes toward an extension of the first side in the axial direction; and a second frame, which is relatively movable to the first frame along an elongated direction of the contact portion at a further extension of the first side in the axial direction, and which comprises a second electrode that is electrically connectable with the contact portion, wherein a radius of curvature of the arch-shaped portion is larger than a radius of the spring portion, and wherein the first frame comprises a lock portion that locks the contact portion to place a center of the arc-shaped portion on a second side, which is opposite to the first side, in the axial direction from an end of the through hole.

According thereto, the radius of curvature of the contact portion is larger than the radius of the spring portion and the lock portion locks the center of the arc of the contact portion so as to be located on another side, in the axial direction, of the end of the through hole on one side in the axial direction. Therefore, when the second frame is moved, the second electrode can be made to smoothly abut on the contact portion even if the contact portion largely protrudes.

According to a third illustrative aspect of the invention, there is provided an electrode member comprising: a spring portion, which has a cylindrically coiled shape, and which extends in an axial direction; and a contact portion, which has a substantially annular shape, and which extends from one side in the axial direction of the spring portion, wherein a diameter of the contact portion is larger than a diameter of the spring portion.

According thereto, the diameter of the contact portion is larger than the diameter of the spring portion, and the diameter of the spring portion is smaller than the diameter of the contact portion. Therefore, the electrode member can be provided in a space-saving manner. Further, an area of a contact point that contacts the spring portion of the first electrode on the substrate or the like can be reduced.

According to a fourth illustrative aspect of the invention, there is provided an electrode member comprising: a spring portion, which has a cylindrically coiled shape, and which extends in an axial direction; and a contact portion, which extends from one side in the axial direction of the spring portion, and which comprises an arc-shaped portion at an end in the axial direction, wherein a radius of curvature of the arc-shaped portion is larger than a radius of the spring portion.

According thereto, the radius of curvature of the contact portion is larger than the radius of the spring portion, and the diameter of the spring portion is smaller than the diameter of the contact portion, the electrode member can be provided in a space-saving manner. Therefore, the area of the contact portion that contacts the spring portion of the first electrode on the substrate or the like can be reduced.

EXEMPLARY EMBODIMENTS

Exemplary embodiments of the invention will now be described with reference to the drawings.

First Exemplary Embodiment

One example of an image forming apparatus 1 is a color laser printer that forms an image of a plurality of colors on a sheet (such as an OHP sheet) as a recording medium electrophotographically. In FIG. 1, a right side of the figure is referred to as a front side, a left side of the figure is referred to as a back side, a side that is on the left when viewed from the front (i.e., a front side) is referred to as a left side, and a side opposite to the left side is referred to as a right side. Based on these definitions, the front-back direction, the right-left direction and the up-down direction are described below.

1. Image Forming Apparatus

Figure 3:
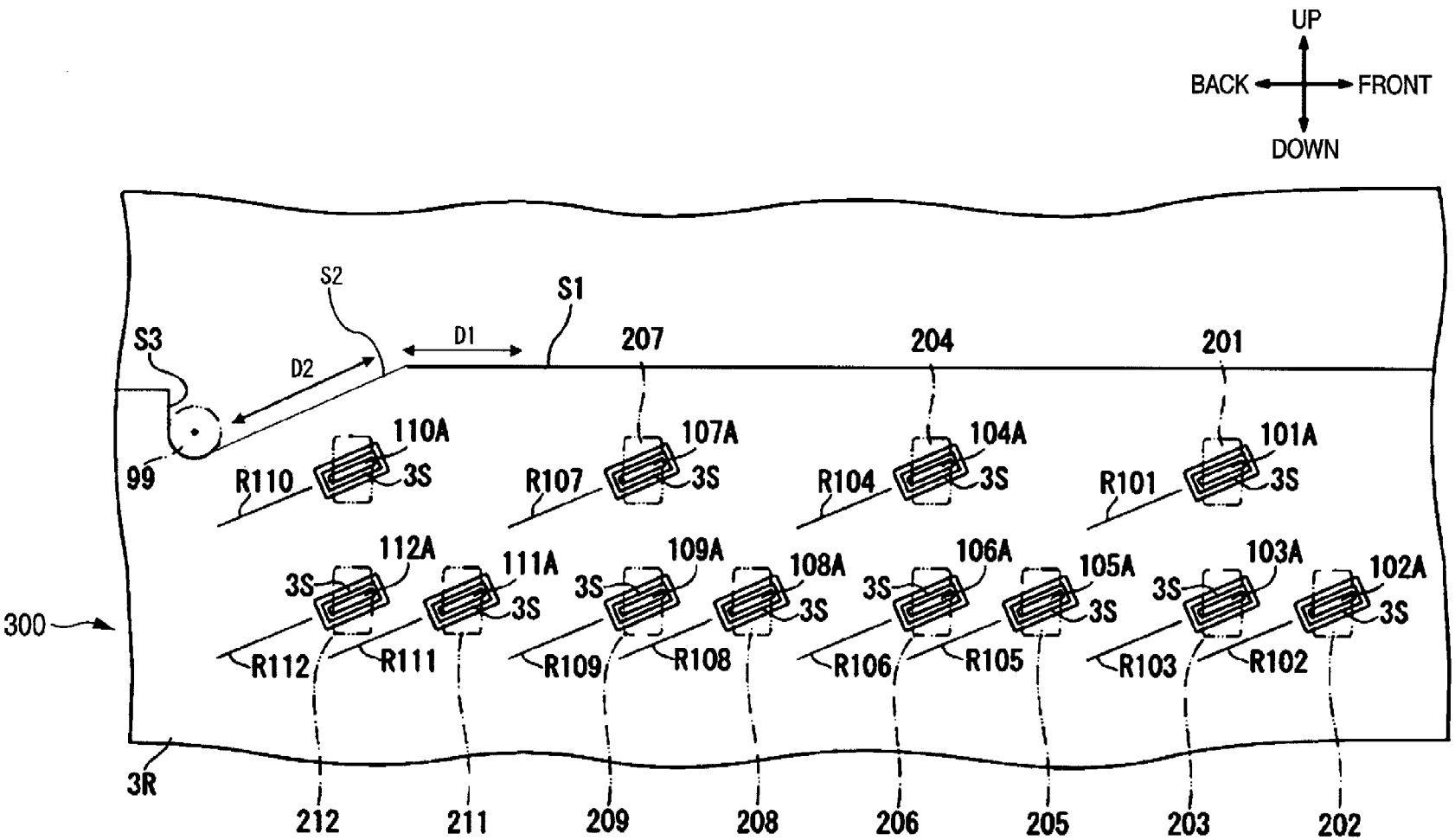
FIG. 3 is an explanatory view showing a positional relation between a first electrode of a frame member and a second electrode of the drawer.

The image forming apparatus 1 includes a housing 3 that has a substantially box shape. The housing 3 includes a frame member (one example of a first frame) 300. Incidentally, FIG. 3 shows one of side walls, a right side wall 3R, of the frame member 300. The frame member 300 includes a feeder unit 20, an image forming unit 10 and a fixing unit 80. The image forming unit 10 is located substantially in a center of the housing 3.

The housing 3 includes a sheet discharge tray 5 on an upper surface thereof. After the image is formed on the sheet, the sheet is discharged from discharge rollers 28 and 29 and is placed on the sheet discharge tray 5. The housing 3 includes a front cover 6 on a front side thereof. The front cover 6 is openable and closable with a lower end side thereof as a center of swing.

2. Feeder Unit

The feeder unit 20 includes a sheet feed tray 21, a sheet feed roller 22 and a separation pad 23. The sheet feed tray 21 is housed in a lower part of the housing 3. The sheet feed tray 21 is detachably attached to the housing 3. The sheet feed roller 22 is provided above the front end portion of the sheet feed tray 21 and feeds (conveys) the sheets in the sheet feed tray 21 to the image forming unit 10. The separation pad 23 separates the sheets fed by the sheet feed roller 22 one at a time by applying a conveyance resistance to the sheets.

Conveyance rollers 24 and 25 are provided on a front part of the sheet conveyance path P, shown by the thick chain double-dashed line in FIG. 1, turning substantially in a U shape. The conveyance rollers 24 and 25 apply a conveyance force to the sheets conveyed to the image forming unit 10 while curving substantially in the U shape.

Registration rollers 26 and 27 are provided on the downstream side of the conveyance rollers 24 and 25 on the conveyance path P. The registration rollers 26 and 27 correct obliquity of the sheets conveyed by the conveyance rollers 24 and 25 by contacting leading ends of the sheets and then convey the sheets toward the image forming unit 10.

3. Image Forming Unit

The image forming unit 10 includes a scanner unit 60, a process unit 10A and a transfer unit 30.

3.1 Scanner Unit

The scanner unit 60 is provided in an uppermost part in the housing 3. The scanner unit 60 includes a laser light source, a polygonal mirror, an fθ lens and a reflecting mirror. The laser light source emits laser beam. The laser beam emitted from the laser light source is deflected by the polygonal mirror, and passes through the fθ lens. Then, the optical path of the laser beam is bent back by the reflecting mirror, and is further bent downward by the reflecting mirror. Accordingly, the laser beam is irradiated onto the surface of a photosensitive drum 71, which is provided on each of the drum subunits, and forms an electrostatic latent image on the photosensitive drum 71.

3.2 Process Unit

The process unit 10A is provided below the scanner unit 60 and above the feeder unit 20. The process unit 10A includes a drawer 90 and developing cartridges 70K to 70C that are attached to the drawer 90 and accommodate toner T of respective colors.

The drawer 90 includes a plurality of (i.e., four) drum subunits that are arranged from the front side to the back side and correspond to the colors, respectively. The drawer is movable in a direction in which the drum subunits are arranged (which will be described later).

Each of the drum subunits includes the photosensitive drum 71 and a scorotron-type charger 72.

The drawer 90 includes a right side frame 92R and a left side frame 92L on both side surfaces thereof. Each of the photosensitive drum 71 has a substantially cylindrical shape and is supported by the right side frame 92R and the left side frame 92L.

Each of the developing cartridges 70K to 70C includes a toner accommodate chamber 74A that accommodates toner, a supply roller 74B and a developing roller 74C. The toner accommodated in the toner accommodate chamber 74A is supplied toward the developing roller 74C by a rotation of the supply roller 74B and is carried on the surface of the developing roller 74C. A thickness of the toner carried on the surface of the developing roller 74C is adjusted to a predetermined thickness by a layer thickness restricting blade 74D. Then, the toner is supplied to the surface of the photosensitive drum 71. The photosensitive drum 71 is provided on the opposite side of a transfer roller 73C with a sheet conveying surface 33A of a conveyance belt 33 in between.

3.3 Transfer Unit

The transfer unit 30 is provided between the sheet feed tray 21 and the image forming unit 10. Incidentally, the sheet feed tray 21 is located below the transfer unit 30, and the image forming unit 10 is located above the transfer unit 30. The transfer unit 30 includes the conveyance belt 33 and transfer rollers 73K, 73Y, 73M and 73C.

The image forming unit 10 includes a driving roller 31 located below the back end side thereof and a following roller 32 located below the front end side thereof. The conveyance belt 33 is wound between the driving roller 31 and the following roller 32. By the driving roller 31 rotating in synchronism with the registration rollers 26 and 27 of the feeder unit 20 and the like, the conveyance belt 33 circulates between the driving roller 31 and the following roller 32. The upper side surface of the conveyance belt 33 is substantially horizontally provided immediately below the image forming unit 10 and serves as the sheet conveying surface 33A. The sheet conveying surface 33A abuts on the back surface of the sheet to convey the sheet along the conveyance path P.

The transfer rollers 73K, 73Y, 73M and 73C are provided in the transfer unit 30 in a condition of abutting on the conveyance belt 33 from the back surface side of the sheet conveying surface 33A. The conveyance belt 33 is made of a conductive rubber. Therefore, the conveyance belt 33 is also charged by a negative charge (transfer voltage) applied to the transfer rollers 73K to 73C. According thereto, the conveyance belt 33 conveys the sheets along the conveyance path P while making the sheets stick fast to the sheet conveying surface 33A by electrostatic force.

4. Fixing Unit

The fixing unit 80 is provided on the downstream side of the image forming unit 10 on the sheet conveyance path P. The fixing unit 80 includes a heating roller 81 and a pressurizing roller 82.

The heating roller 81 is provided on an image forming surface side of the sheet. The heating roller 81 rotates in synchronism with the conveyance belt 33 and the like and applies a conveyance force to the sheet while heating the toner transferred onto the sheet.

The pressurizing roller 82 is provided on a side opposite to the heating roller 81 with interposing the sheet therebetween. The pressurizing roller 82 rotates to follow the heating roller 81 while pressing the sheet toward the heating roller 81.

According thereto, the fixing unit 80 fixes the toner onto the sheet by heating and fusing the toner and conveys the sheet toward the downstream side of the conveyance path P. The conveyance path P curves upward substantially in a U shape on the downstream side of the fixing unit 80. The discharge rollers 28 and 29 that discharge the sheet, on which the image formed, to the sheet discharge tray 5 are provided immediately in front of the sheet discharge tray 5 on the most downstream side of the conveyance path P.

5. Image Forming Operation

The image forming apparatus 1 forms the image on the sheet in the following manner: When an image forming operation is started, the feeder unit 20 and the transfer unit 30 operate to convey the sheet to the image forming unit 10, and the scanner unit 60, the developing cartridges 70K to 70C and the like operate. Then, the surface of the photosensitive drum 71 is charged by the charger 72 while being rotating and is then exposed by the laser beam emitted from the scanner unit 60. Accordingly, an electrostatic latent image corresponding to the data for image formation is formed on the surface of the photosensitive drum 71.

Then, by the rotation of the developing roller 74C, the toner, which is carried on the developing roller 74C and is positively charged, is supplied to the electrostatic latent image formed on the surface of the photosensitive drum 71 when contacting the photosensitive drum 71. Accordingly, the electrostatic latent image on the photosensitive drum 71 is visualized, and a toner image by a reversal development is carried on the surface of the photosensitive drum 71.

The toner image, which is carried on the surface of the photosensitive drum 71, is transferred onto the sheet by a transfer voltage applied to the transfer rollers 73K to 73C. When the sheet, on which the toner image transferred, is conveyed to the fixing unit 80, the sheet is heated and pressurized by the heating roller 81 and the pressurizing roller 82, and the toner image is fixed to the sheet. The sheet, on which the image is formed, is discharged to the sheet discharge tray 5. According thereto, the image forming operation is completed.

6. Drawer

Figure 2:
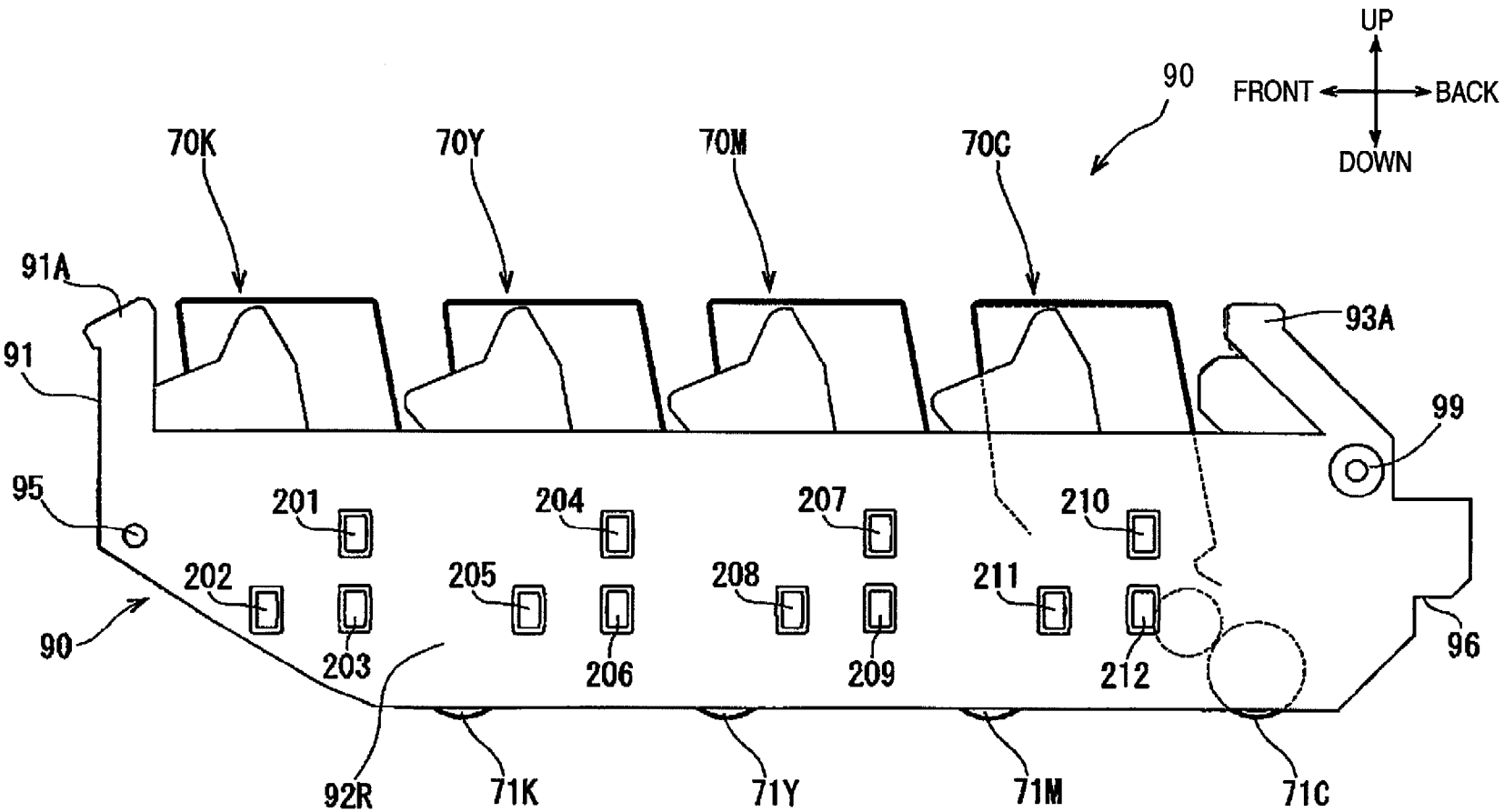
FIG. 2 is a right side view of a drawer of the image forming apparatus.

As shown in FIGS. 1 and 2, the drawer 90 includes a front wall 91, the right side frame 92R (shown in FIG. 2) and the left side frame 92L that are one example of a second frame and a back wall 93. Incidentally, the left side frame 92L is located on the back side of the plane of FIG. 2 with respect to the right side frame 92R. The drawer 90 is configured by combining the front wall 91, the right side frame 92R, the left side frame 92L and the back wall 93 in a rectangular form. The upper side and the lower side of the drawer 90 are opened.

A handle 91A (front side) and a handle 93A (back side) are protruded upward from the upper ends of the front wall 91 and the back wall 93, respectively. The handles 91A and 93A are used for attaching or detaching the drawer 90 to or from the housing 3 by the user.

As shown in FIG. 2, second electrodes 201 to 212 are arranged in two rows, one above the other, at predetermined intervals in the front-back direction. The second electrodes 201 to 212 are rectangular metal pieces. A pair of cam followers 99 is supported in an upper part on the back end side of the right frame 92R and left side frame 92L in a rotatable manner. The pair of cam followers 99 protrudes outward in the right-left direction (i.e., the front side and the back side of the plane of FIG. 2). The right and left cam followers 99 have the shaft centers on the same line in the right-left direction.

The second electrodes 201 to 212 are substantially flush with the side surface of the right side frame 92R so as not to largely protrude from the right side frame 92R in order to reduce a size of the drawer 90. In the drawer 90, the second electrodes 201, 204, 207 and 210 are electrically connected with the developing rollers 74C corresponding to the developing cartridges 70K to 70C, respectively. The second electrodes 202, 205, 208 and 211 are electrically connected with the photosensitive drums 71 corresponding to the developing cartridges 70K to 70C, respectively. The second electrodes 203, 206, 209 and 212 are electrically connected with the chargers 72 corresponding to the developing cartridges 70K to 70C, respectively.

7. Frame Member

As shown in FIG. 3, a first guide surface S1 and a second guide surface S2 are formed on the right side wall 3R and the left side wall 3L of the frame member 300. The first and second guide surfaces S1 and S2 guide the cam followers 99 of the drawer 90 when the drawer 90 is attached to or detached from the housing 3.

As shown in FIG. 3, the first guide surface S1 is a plane elongated in the front-back direction. The second guide surface S2 is a plane slanting obliquely downward toward the back side of the apparatus. The back side end of the first guide surface S1 and the front side end of the second guide surface S2 are continuous with each other. On the right side wall 3R, a stopper surface S3 is formed that bends from the back end of the second guide surface S2 and rises upward.

8. Right Side Wall

Figure 4B:
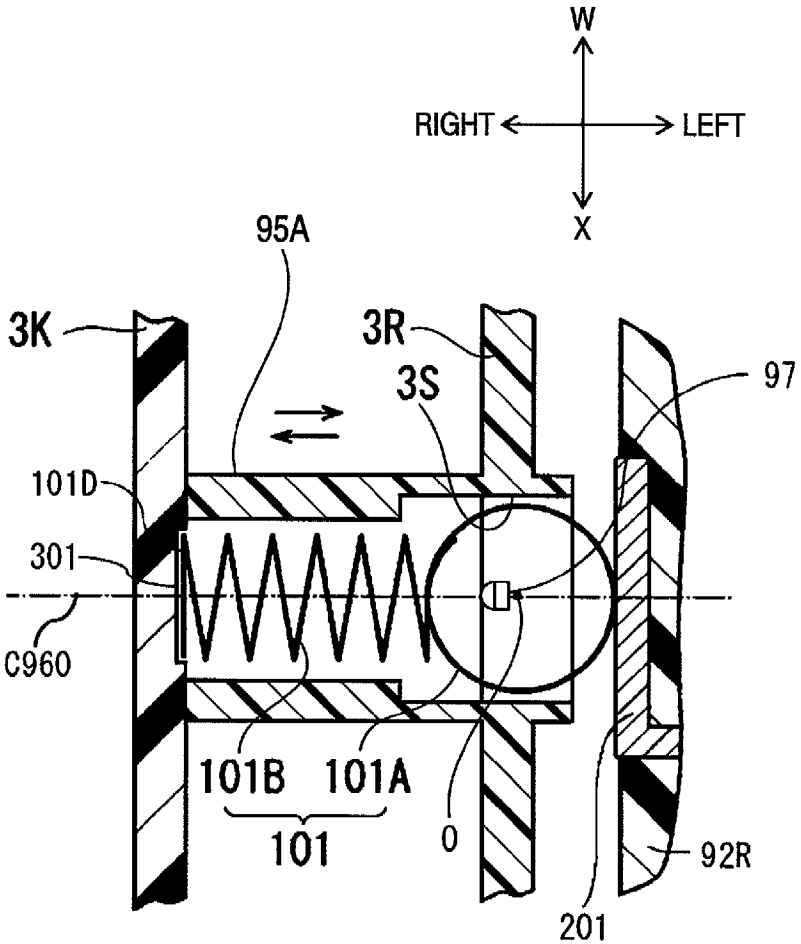
FIGS. 4A and 4B are explanatory views showing movements of the first electrode when the drawer is attached.
Figure 4A:
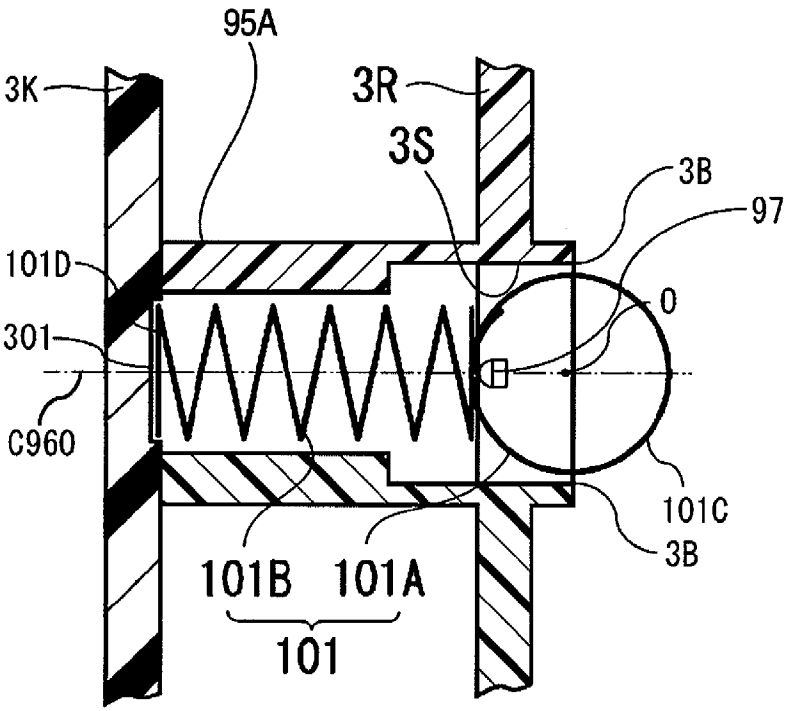

As shown in FIG. 3, the right side wall 3R, which is opposed to the drawer 90 from the right side when the drawer 90 is attached, includes a cylindrical portion 95A and a slit 3S (one example of a through hole). As shown in FIGS. 4A and 4B, when first electrodes, which will be described later, are installed to the right side wall 3R, the cylindrical portion 95A covers a spring portion 101B in the right-left direction, and the slit 3S makes a part of a contact portion 101A (one example of an annular contact portion) of a first electrode 101 protrude toward the side where the drawer 90 is provided. On the right side wall 3R, the first electrodes 101 to 112 are provided in positions opposed to the second electrodes 201 to 212, respectively, in the drawer attached condition shown in FIG. 1. Incidentally, since the first electrodes 101 to 112 have the same structure, the first electrode 101 will be described, and descriptions of the first electrodes 102 to 112 are omitted.

As shown in FIG. 7, the first electrode 101 includes the contact portion 101A and the spring portion 101B. The contact portion 101A and the spring portion 101B are formed by bending one metal wire.

The spring portion 101B is bent in a coiled spring form with a central axis C101 as the center.

The contact portion 101A is formed by bending the wire from an end portion of the spring portion 101B in an annular shape along a plane R101 parallel to the direction of the central axis C101 of the coiled spring. The contact portion 101A has a diameter larger than a winding diameter of the coiled spring. The plane R101, along which the contact portion 101A is laid, is parallel to the central axis C101 of the spring portion 101B and includes the central axis C101. As shown in FIG. 3, when the first electrode 101 is installed to the right side wall 3R, the plane R101 of the contact portion 101A is substantially parallel to a direction (second direction D2) along the second guide surface S2. The contact portion 101A is formed by closely winding the metal wire twice, for example, in an annular shape.

In the description that follows, as shown in FIGS. 4A and 4B, a direction in which the direction of the length of an arc-shaped part 101C extends will be referred to as a WX direction. The arc-shaped part 101C is a part of the contact portion 101A protruding from the slit 3S. A direction orthogonal to the direction in which the direction of the length extends and to the central axis C101 of the spring portion 101B will be referred to as a YZ direction. More specifically, in FIG. 5, the left side of the plane of the figure will be referred to as the W side, the right side thereof, as the X side, the upper side thereof, as the Y side, and the lower side thereof, as the Z side.

As shown in FIGS. 4A and 4B, a substrate 3K, on which an electric circuit is formed, is formed at the right side of the right side wall 3R of the frame member 300. The cylindrical portion 95A extends rightward (i.e., the other side of the central axis C101 of the spring portion 101B) from the right side wall 3R to the substrate 3K. The axis C960 of the cylindrical portion 95A extends in the right-left direction like the central axis C101 of the spring portion 101B. A contact portion 301 is formed on the substrate 3K. The contact portion contacts a substrate side contact point 101D of the spring portion 101B. The contact portion 301 is substantially as large as the spring portion 101B. The first electrode 101 and the electric circuit on the substrate 3K are brought into conduction by contacting the contact portion 301 with the substrate side contact point 101D of the spring portion 101B. At this time, the spring portion 101B is compressed between the substrate 3K and a lock portion 97 (which will be described later).

Figure 5:
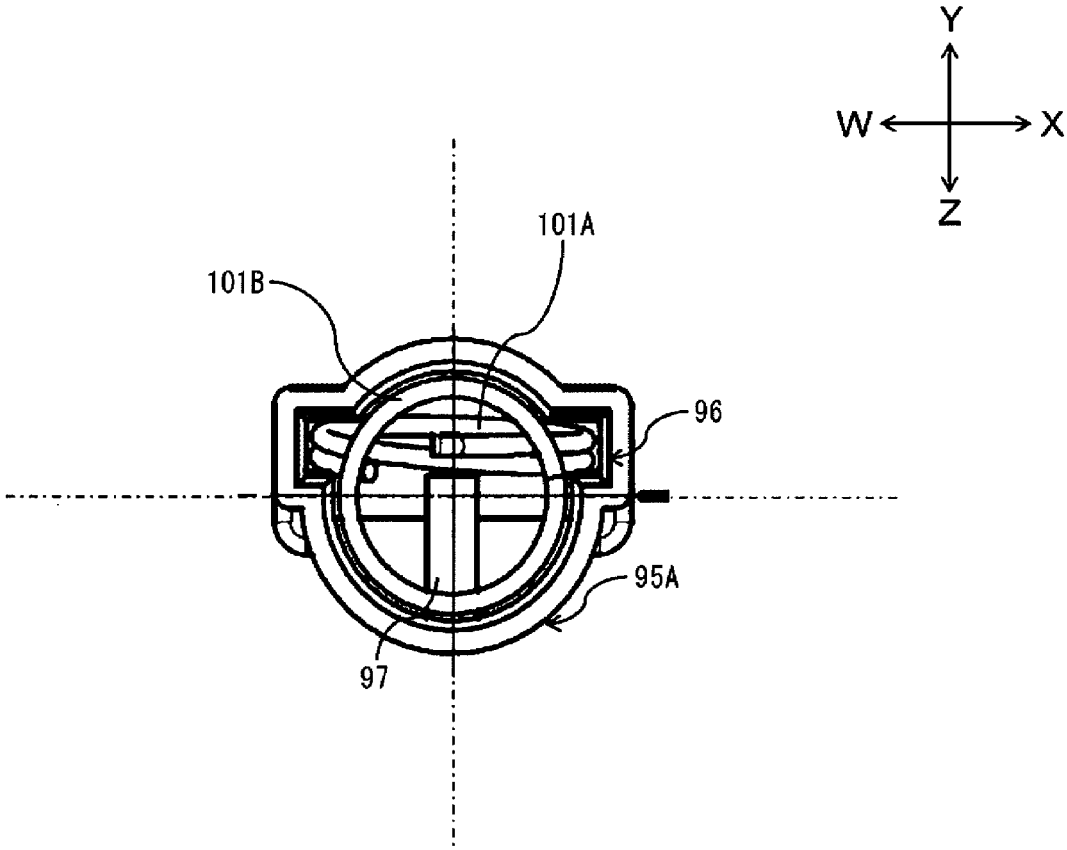
FIG. 5 is an explanatory view showing a positional relation of a guide groove in a cylindrical portion.

As shown in FIGS. 4A to 5, a guide groove 96 and the lock portion 97 are formed on the inner surface of the cylindrical portion 95A. The guide groove 96 guides the first electrode in the direction of the axis C960 of the cylindrical portion 95A. The lock portion 97 locks the contact portion 101A of the first electrode 101.

As shown in FIGS. 6A to 6D, the guide groove 96 includes a guide groove portion 96A and an engagement groove portion 96B. The guide groove portion 96A guides the contact portion 101A leftward (i.e., toward one side of the direction of the central axis C101 of the spring portion 101B). The engagement groove portion 96B guides the contact portion 101A from the guide groove portion 96A toward the Z side to engage the contact portion 101A with the lock portion 97.

As shown in FIGS. 5 and 6A, a side wall of the guide groove portion 96A in the Z side is located on the Y side of a distal end of the lock portion 97. The guide groove portion 96A is substantially as large as the contact portion 101A of the first electrode 101. As shown in FIG. 6B, the engagement groove portion 96B has a groove shape wider toward the Z side than the guide groove portion 96A.

The lock portion 97 is provided in an area where the engagement groove portion 96B is formed. The lock portion 97 protrudes toward the Y side from the inner surface of the cylindrical portion 95A opposed to the engagement groove portion 96B. As shown in FIG. 4A, the lock portion 97 locks the contact portion 101A so that a center O of the circle of the contact portion 101A is located on the right side of the left end 3B of the slit 3S. At this time, the lock portion 97 abuts on the right side inner surface of the contact portion 101A.

As shown in FIG. 6B, the lock portion 97 is formed so that the distance L1 from the right side end of the cylindrical portion 95A to the left side surface of the lock portion 97 is longer than the diameter L2 of the contact portion 101A of the first electrode 101.

9. Installation of First Electrode to Right Side Wall

Referring to FIGS. 6A to 6D, an operation of installing the first electrode 101 to the right side wall 3R will be described.

First, as shown in FIG. 6A, the contact portion 101A of the first electrode 101 is inserted into the guide groove portion 96A formed in the cylindrical portion 95A.

When the first electrode 101 is further inserted, the spring portion 101B of the first electrode 101 and the inner surface of the cylindrical portion 95A abut on each other. Then, as shown in FIG. 6B, the spring portion 101B is inserted leftward while abutting on the inner surface of the cylindrical portion 95A. At this time, since the guide groove portion 96A is formed on the Y side of the distal end of the lock portion 97, the part of the spring portion 101B abutting on the inner surface of the cylindrical portion 95A receives a pressing force toward the axis C960 of the cylindrical portion 95A (toward the Z side) from the cylindrical portion 95A.

By the spring portion 101B being pressed, the contact portion 101A is forced to move toward the Z side. The guide groove portion 96A guides the contact portion 101A leftward while restricting the movement.

Then, as shown in FIG. 6C, when the back end of the contact portion 101A is inserted up to the engagement groove portion 96B, the pressing force of the guide groove portion 96A restricting the movement of the contact portion 101A toward the Z side is canceled since the engagement groove portion 96B is wider toward the Z side than the guide groove portion 96A. Consequently, the contact portion 101A moves toward the Z side where the lock portion 97 is provided.

Consequently, as shown in FIG. 6D, the first electrode 101 moves to a position where the right side inner surface of the contact portion 101A and the lock portion 97 can abut on each other in the right-left direction. At this time, the lock portion 97 penetrates the plane R101 of the contact portion 101A.

10. Contact Between First Electrode and Second Electrode in Accordance with Attachment or Detachment of Drawer Referring to FIGS. 3 to 4B, the contact between the first electrode 101 and the second electrode 201 in accordance with attachment or detachment of the drawer 90 will be described. Incidentally, the contact between the first electrode 101 and the second electrode 201 can also be applied to contact between the first electrodes 102 to 112 and the second electrodes 202 to 212, and thus descriptions thereof are omitted as appropriate.

10.1 Attachment of Drawer

Figure 8:
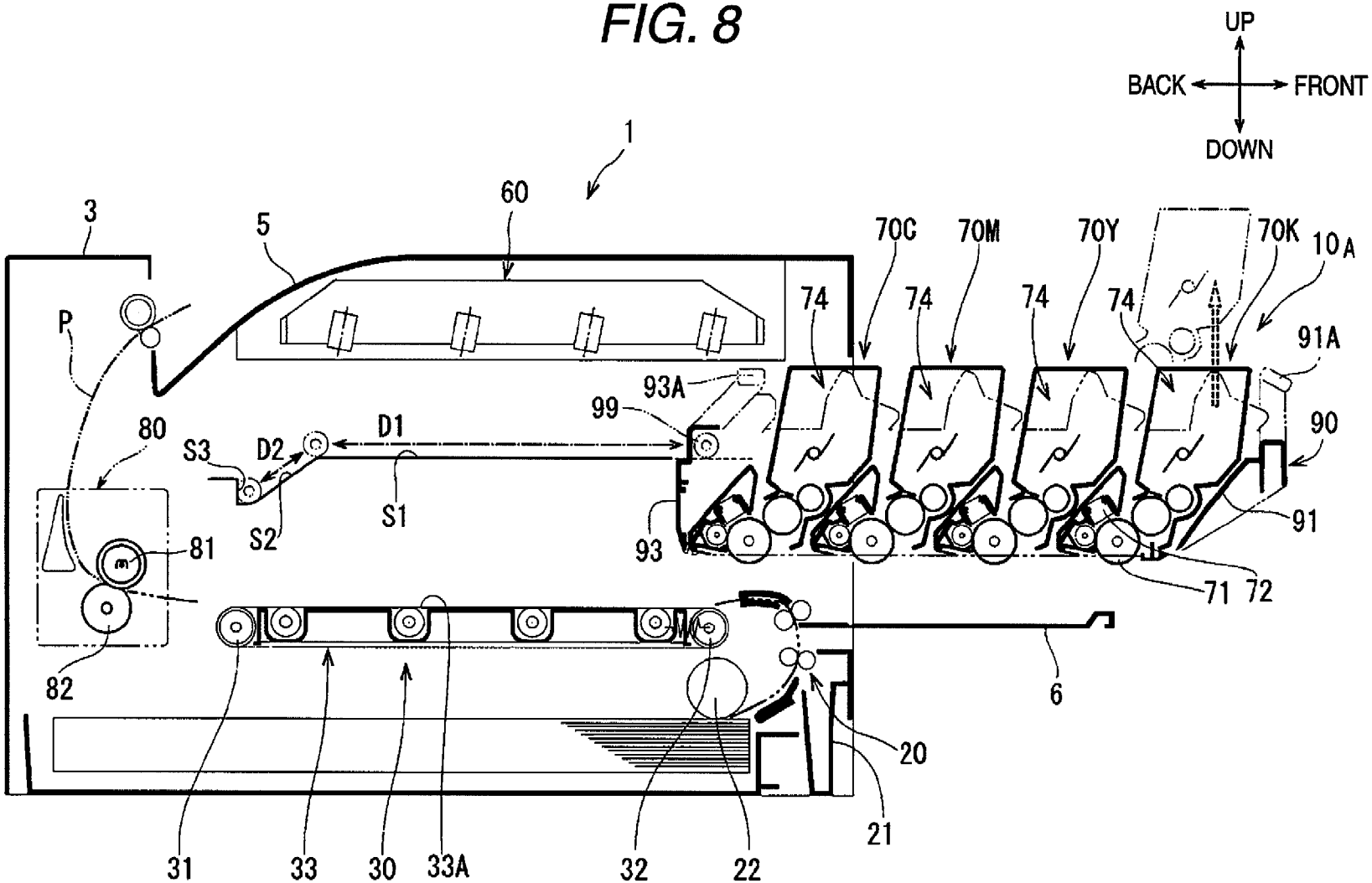
FIG. 8 is an explanatory view showing attachment of the drawer.

Under a condition where the drawer 90 is detached from the housing 3 as shown in FIG. 8, the drawer 90 is inserted into the housing 3 with the cam followers 99 being placed on the first guide surface S1. Then, the cam followers 99 roll in the front-back direction (first direction D1) along the first guide surface S1. Consequently, the drawer 90 is inserted in the first direction D1.

When the drawer 90 is further inserted into the housing 3, the cam followers 99 move from the first guide surface S1 to the second guide surface S2, and rolls obliquely downward (the second direction D2) along the second guide surface S2. Consequently, the drawer 90 is inserted obliquely downward in the slanting second direction D2. Then, as shown in FIG. 1, the cam followers 99 abut on the stopper surface S3 to stop. At this time, the front end portions of the right side frame 92R and the left side frame 92L of the drawer 90 are placed on protrusions (not shown) protruding inward on the front end sides of the right side wall 3R and the left side wall 3L, so that the drawer 90 is substantially horizontally supported by the right side wall 3R and the left side wall 3L. In this manner, the drawer 90 can be attached to the right side wall 3R and the left side wall 3L.

When the drawer 90 is inserted into the housing 3 in the first direction D1 and further inserted in the second direction D2, the right side frame 92R and the second electrode 201 move along the similar path. At this time, the back end portion of the right side frame 92R in the middle of the movement abuts on the contact portion 101A on the right side wall 3R side. Then, the contact portion 101A is pressed toward the right side wall 3R side from the condition shown in FIG. 4A to be displaced in a direction parallel to the right-left direction and in which the contact portion 101A retracts from the right side frame 92R. Then, until the drawer 90 is moved to the attachment position, the right side frame 92R moves while the right side frame 92R and the second electrode 201 of the drawer 90 and the contact portion 101A provided on the right side wall 3R are rubbing against each other. In this manner, the first electrode 101 contacts the second electrode 201 to be electrically connected therewith in a position where the attachment of the drawer 90 is completed shown in FIG. 4B. At this time, the first electrode 101 is compressed between the second electrode 201 and the substrate 3K, and the pressing force ensures stable continuity.

10.2 Detachment of Drawer

The drawer is detached from the housing 3 by an operation reverse to the attachment operation.

Figure 9:
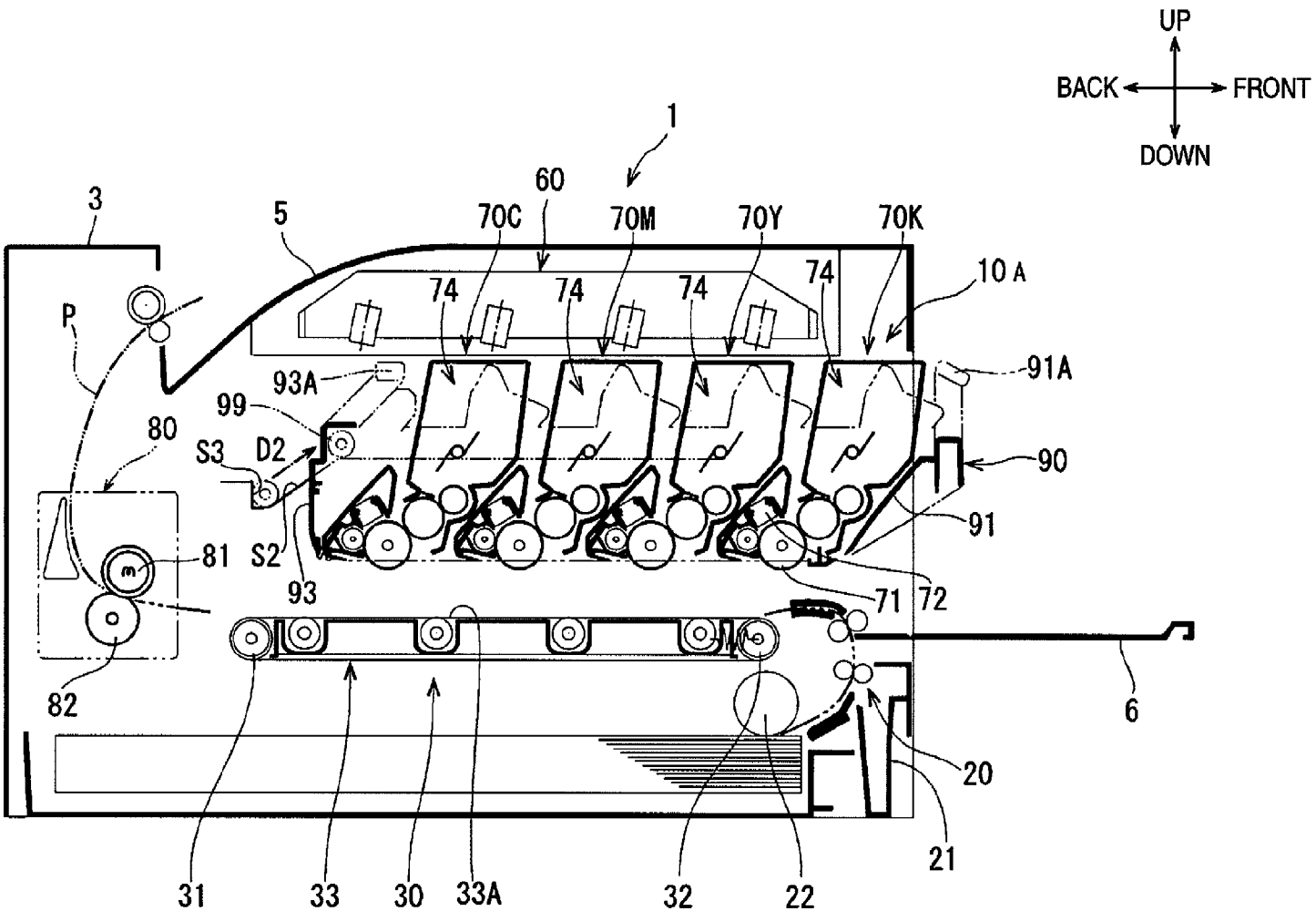
FIG. 9 is an explanatory view showing detachment of the drawer.

That is, as shown in FIG. 9, the handle 91A on the front end side of the drawer 90 is held and drawn frontward with the front cover 6 being opened. Then, the cam followers 99 roll obliquely upward along the second guide surface S2. Accordingly, the drawer 90 is drawn out obliquely upward in the second direction D2 parallel to the slanting second guide surface S2. Therefore, the photosensitive drums 71 are separated from the transfer rollers 73K to 73C in an obliquely upward direction.

When the drawer 90 is further drawn frontward, as shown in FIG. 8, the cam followers 99 move from the second guide surface S2 to the first guide surface S1, and rolls in the front-back direction along the first guide surface S1. Accordingly, the drawer 90 is drawn out in the first direction D1 parallel to the first guide surface S1. Toner cartridges 74 can be attached to and detached from the drawer 90 while the drawer 90 is drawn out. The drawer 90 can be detached from the housing 3 by holding and lifting up the handles 91A and 93A in the position where the drawer 90 is drawn out.

When the drawer 90 is drawn out in the second direction D2 from the housing 3 and is further drawn out in the first direction D1, the right side frame 92R and the second electrode 201 move along a similar path. At this time, the right side frame 92R moves while the right side frame 92R and the second electrode 201, and the contact portion 101A are rubbing against each other. Then, when the right side frame 92R is separated from the contact portion 101A, the contact portion 101A is displaced by the pushing force of the spring portion 101B in a direction parallel to the right-left direction and in which the contact portion 101A approaches the right side frame 92R, and returns to the original condition (see FIG. 4A). In this manner, the first electrode 101 is separated from the second electrode 201 to cut off the electrical connection.

As described above, the diameter of the contact portion 101A is larger than the diameter of the spring portion 101B and the lock portion 97 locks the contact portion 101A so that the center O of the circle of the contact portion 101A is located on the right side of the left end 3B of the slit 3S. Therefore, even if the contact portion 101A largely protrudes leftward from the right side wall 3R, the second electrode 201 can be made to smoothly abut on the contact portion 101A when the drawer 90 is moved. According thereto, electrical connection can be facilitated between the first electrode 101 and the second electrode 201.

The radius of curvature of the arc-shaped part 101C which is the part of the contact portion 101A protruding from the slit 3S is larger than the radius of the spring portion 101B and the lock portion 97 locks the contact portion 101A so that the center O of the arc-shaped part 101C of the contact portion 101A is located on the right side of the left end 3B of the slit 3S. Therefore, even if the contact portion 101A largely protrudes leftward from the right side wall 3R, the second electrode 201 can be made to smoothly abut on the contact portion 101A when the drawer 90 is moved.

The diameter of the spring portion 101B is smaller than the diameter of the contact portion 101A. Therefore, the diameter of the cylindrical portion 95A can be reduced. Further, the contact portion 301 on the substrate 3K is substantially as large as the contact point 101D on the substrate side of the spring portion 101B. Therefore, the size of the contact portion 301 can be reduced.

The cylindrical portion 95A is formed so as to cover the spring portion 101B in the right-left direction. Therefore, even if the plurality of first electrodes 101 to 112 are provided nearby, the spring portions do not contact each other, so that the electrical connection can be more facilitated between the first electrode 101 and the second electrode 201.

The guide groove portion 96 is formed in the direction of the axis C960 of the cylindrical portion 95A on the inner surface of the cylindrical portion 95A. Therefore, when the first electrode 101 is installed to the right side wall 3R, the direction in which the contact portion 101A of the first electrode 101 is inserted can be unified.

The lock portion 97 is formed so as to pass through the plane R101 of the contact portion 101A when the first electrode 101 is installed to the right side wall 3R. Therefore, the first electrode 101 can be prevented from readily coming off even if the first electrode 101 is inadvertently moved in a direction (rightward) opposite to the direction in which the first electrode 101 is inserted after the first electrode 101 is attached. Accordingly, the first electrode 101 does not readily come off from the right side wall 3R, and thus the substrate 3K and the frame member 300 can be easily installed together.

The guide groove portion 96A is formed on the Y side of the lock portion 97 of the distal end of the lock portion 97. Therefore, when the first electrode 101 is inserted in the guide groove portion 96A, the contact portion 101A can be moved to a position where the right side inner surface of the contact portion 101A and the lock portion 97 can abut on each other without the end of the contact portion 101A and the lock portion 97 contacting each other.

The lock portion 97 is formed so that the distance L1 from the right side end of the cylindrical portion 95A to the left side surface of the lock portion 97 is longer than the diameter L2 of the contact portion 101A of the first electrode 101. Therefore, the length of the cylindrical portion 95A can be increased.

The guide groove 96 includes the guide groove portion 96A and the engagement groove portion 96B. The guide groove 96 is formed such that, when the contact portion 101A of the first electrode 101 is inserted along the guide groove portion 96A and the back end of the contact portion 101A is moved to the engagement groove portion 96B, the contact portion 101A moves toward Z side where the lock portion 97 is formed by the restoring force of the spring of the first electrode 101. Accordingly, even if the length of the cylindrical portion 95A is long, by the insertion of the first electrode 101 into the guide groove 96 by the person who installs the first electrode 101, the first electrode 101 can be easily installed to a position where the inner surface of the contact portion 101A and the lock portion 97 are locked.

The contact portion 101A is closely wound twice in an annular shape. Thus, the contact portion 101A has higher strength than that of the spring portion 101B. Therefore, even when the contact portion 101A contacts the second electrode 201 and the first electrode 101 is pressed in a direction in which the first electrode 101 retracts, the annular shape of the contact portion 101A can be prevented from being deformed prior to the spring portion 101B.

Second Exemplary Embodiment

A second exemplary embodiment of the invention will now be described.

In the second exemplary embodiment, only differences from the first exemplary embodiment will be described. Parts similar to those of the first exemplary embodiment are denoted by the same reference numerals and descriptions thereof are omitted.

1. Right Side Wall

Figure 10:
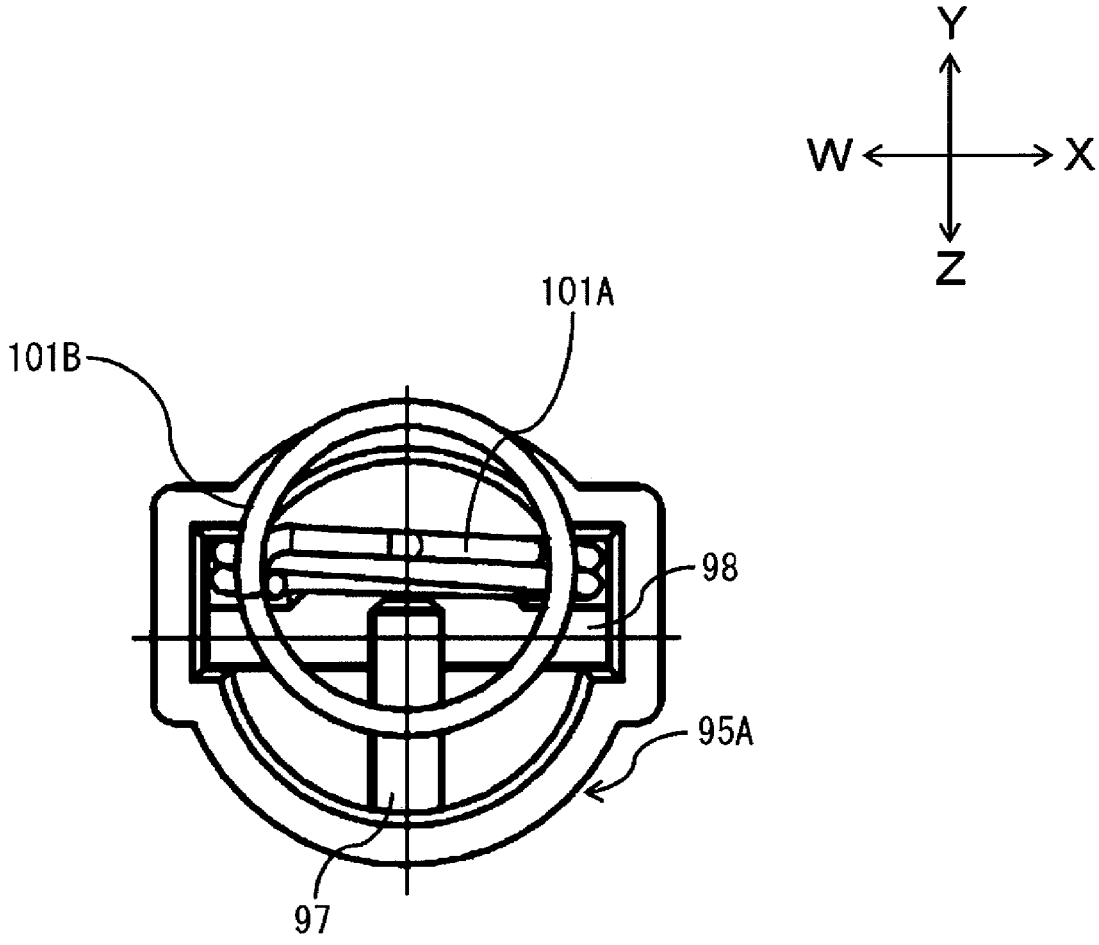
FIG. 10 is an explanatory view showing a positional relation of a guide groove in a cylindrical portion.
Figures 11A, 11B, 11C:
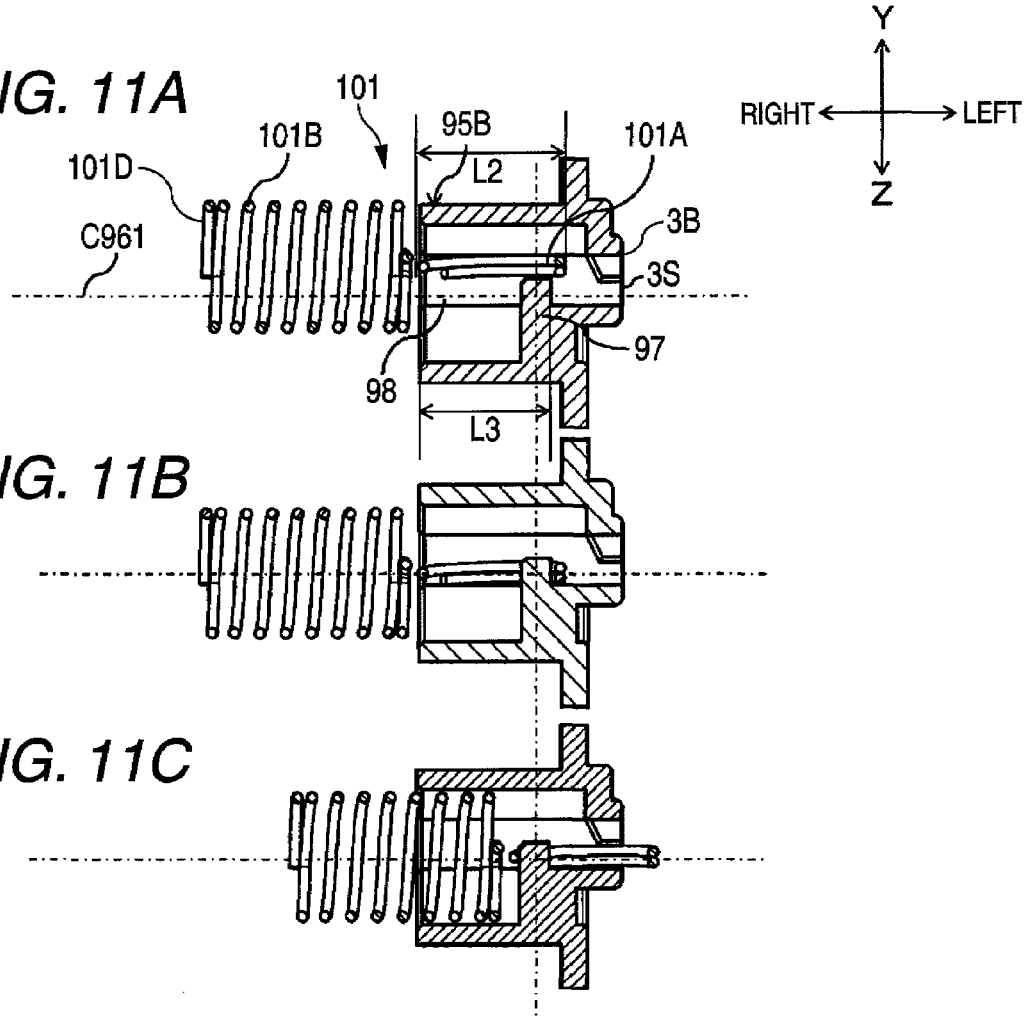
FIGS. 11A to 11C are explanatory views showing operations of installing the first electrode to the frame member.

As shown in FIGS. 10 to 11C, a guide groove 98 and the lock portion 97 are formed on the inner surface of a cylindrical portion 95B. The guide groove 98 guides the first electrode 101 along an axis C961 of a cylindrical portion 95B (see FIGS. 11A to 11C). The lock portion 97 locks the contact portion 101A of the first electrode 101. The axis C961 of the cylindrical portion 95B extends in the right-left direction like the central axis C101 of the spring portion 101B.

As shown in FIGS. 10 to 11C, the guide groove 98 has a wide groove shape so that the contact portion 101A can move in the YZ direction.

The lock portion 97 is provided in an area where the guide groove 98 is formed. The lock portion 97 protrudes toward the Y side from the inner surface of the cylindrical portion 95B opposed to the guide groove 98. As shown in FIG. 11A, the lock portion 97 is formed so that the distance L3 from the right side end of the cylindrical portion 95B to the left side surface of the lock portion 97 is shorter than the diameter L2 of the contact portion 101A of the first electrode 101.

2. Installation and Disinstallation of First Electrode to and from Right Side Wall Referring to FIGS. 11A to 11C, an operation of installing the first electrode 101 to the right side wall 3R will be described.

First, as shown in FIG. 11A, the contact portion 101A of the first electrode 101 is inserted into the guide groove 98. At this time, the contact portion 101A is moved to the Y side of the distal end of the lock portion 97 so that the end of the contact portion 101A does not abut on the right side surface of the lock portion 97, and the contact portion 101A is then inserted leftward.

Then, as shown in FIG. 11B, when the left side inner surface of the contact portion 101A reaches the position facing the end of the lock portion 97, the contact portion 101A is moved toward the Z side where the lock portion 97 is formed. When the first electrode 101 is further inserted the end of the contact portion 101A protrudes from the slit 3R as shown in FIG. 11C.

The first electrode 101 is disinstalled from the right side wall 3R by an operation reverse to the installation operation.

When the contact portion 101A is moved from the condition shown in FIG. 11C in a direction (rightward) opposite to the direction in which the first electrode 101 is inserted, the left side inner surface of the contact portion 101A abuts on the lock portion 97 as shown in FIG. 11B.

Then, when the contact portion 101A is moved toward the Y side, a condition where the inner surface of the contact portion 101A and the lock portion 97 can abut on each other in the right-left direction is canceled as shown in FIG. 11A. At this time, since the spring portion 101B does not abut on the inner surface of the cylindrical portion 95B, the spring portion 101B can be easily moved toward the Y side.

Then, when the first electrode 101 is moved rightward, the first electrode 101 can be taken out from the cylindrical portion 95B.

According to the second exemplary embodiment, the lock portion 97 is formed so that the distance L3 from the right side end of the cylindrical portion 95B to the left side surface of the lock portion 97 is shorter than the diameter L2 of the contact portion 101A of the first electrode 101. Therefore, when the left side inner surface of the contact portion 101A reaches the position facing the end of the lock portion 97, the left side end of the spring portion 101B and the inner surface of the cylindrical portion 95B do not abut on each other. That is, since the spring portion 101B and the cylindrical portion 95B do not abut on each other when the lock portion 97 and the inner surface of the contact portion 101A are disengaged from each other, the first electrode 101 can be easily moved toward the Y side. According thereto, the first electrode 101 can be easily taken out from the right side wall 3R.

Modification to Exemplary Embodiments

Exemplary embodiments of the present invention are not limited to the above-described exemplary embodiments and may take various forms within the technical scope of the present invention.

In the above-described exemplary embodiments, the plane R101 of the contact portion 101A is provided substantially parallel to D2 when the first electrode 101 is installed to the right side wall 3R. Alternatively, the plane R101 of the contact portion 101A may be provided so as to incline from a range of inclining 45 degrees upward to a range of inclining 45 degrees downward.

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. An image forming apparatus comprising:

a first electrode comprising:

a spring portion, which has a cylindrically coiled shape, and which extends in an axial direction; and an annular contact portion, which extends from a first side in the axial direction of the spring portion, and which has an elongated shape viewed from the axial direction;

a first frame comprising a through hole, which passes through the first frame in the axial direction, and through which a part of the annular contact portion protrudes toward an extension of the first side in the axial direction; and a second frame, which is relatively movable to the first frame along an elongated direction of the annular contact portion at a further extension of the first side in the axial direction, and which comprises a second electrode that is electrically connectable with the annular contact portion, wherein a diameter of the annular contact portion is larger than a diameter of the spring portion, and wherein the first frame comprises a lock portion that locks the annular contact portion to place a center of the annular contact portion on a second side, which is opposite to the first side, in the axial direction from an end of the through hole.

2. The image forming apparatus according to claim 1, wherein the first frame further comprises a cylindrical portion, which has a cylindrical shape, and which covers the spring portion in the axial direction, and wherein the lock portion is abuttable on an inner surface of the annular contact portion at a side closer to the spring portion.

3. The image forming apparatus according to claim 2, wherein the cylindrical portion comprises a guide groove that guides the annular contact portion in the axial direction on an inner surface of the cylindrical portion.

4. The image forming apparatus according to claim 3, wherein the lock portion protrudes in a perpendicular direction, which is substantially perpendicular to the annular direction, to pass through the annular contact portion, and wherein an end of the guide groove in the perpendicular direction is located further in the perpendicular direction from a distal end of the lock portion.

5. The image forming apparatus according to claim 4, wherein a length from an end of the cylindrical portion on the second side in the axial direction to the lock portion is shorter than a length of the annular contact portion in the axial direction.

6. The image forming apparatus according to claim 4, wherein a length from an end of the cylindrical portion on the second side in the axial direction to the lock portion is longer than a length of the annular contact portion in the axial direction, and wherein the guide groove enables the annular contact portion to move toward the lock portion when the annular contact portion is located in a position facing the distal end of the lock portion in the perpendicular direction.

7. An image forming apparatus comprising:

a first electrode comprising:

a spring portion, which has a cylindrically coiled shape, and which extends in an axial direction; and a contact portion, which extends from a first side in the axial direction of the spring portion, which has an elongated shape viewed from the axial direction, and which comprises an arch-shaped portion at an end in the axial direction;

a first frame comprising a through hole, which passes through the first frame in the axial direction, and through which the arch-shaped portion protrudes toward an extension of the first side in the axial direction; and a second frame, which is relatively movable to the first frame along an elongated direction of the contact portion at a further extension of the first side in the axial direction, and which comprises a second electrode that is electrically connectable with the contact portion, wherein a radius of curvature of the arch-shaped portion is larger than a radius of the spring portion, and wherein the first frame comprises a lock portion that locks the contact portion to place a center of the arc-shaped portion on a second side, which is opposite to the first side, in the axial direction from an end of the through hole.

8. The image forming apparatus according to claim 7, wherein the first frame further comprises a cylindrical portion, which has a cylindrical shape, and which covers the spring portion in the axial direction, and wherein the lock portion is abuttable on an inner surface of the contact portion at a side closer to the spring portion.

9. The image forming apparatus according to claim 8, wherein the cylindrical portion comprises a guide groove that guides the contact portion in the axial direction on an inner surface of the cylindrical portion.

10. The image forming apparatus according to claim 9, wherein the lock portion protrudes in a perpendicular direction, which is substantially perpendicular to the axial direction, to pass through the contact portion, and wherein an end of the guide groove in the perpendicular direction is located further in the perpendicular direction from a distal end of the lock portion.

11. The image forming apparatus according to claim 10, wherein a length from an end of the cylindrical portion on the second side in the axial direction to the lock portion is shorter than a length of the contact portion in the axial direction.

12. The image forming apparatus according to claim 10, wherein a length from an end of the cylindrical portion on the second side in the axial direction to the lock portion is longer than a length of the contact portion in the axial direction, and wherein the guide groove enables the contact portion to move toward the lock portion when the contact portion is located in a position facing the distal end of the lock portion in the perpendicular direction.

13. An electrode member comprising:

a spring portion, which has a cylindrically coiled shape, and which extends in an axial direction along a central axis; and a contact portion, which has a substantially annular shape, which extends along a plane parallel to the central axis of the spring portion, and which extends from one side in the axial direction of the spring portion, wherein a diameter of the contact portion is larger than a diameter of the spring portion.

14. The electrode member according to claim 13, wherein the contact portion comprises a wire, and wherein the contact portion is wound the wire twice or more.

15. An electrode member comprising:

a spring portion, which has a cylindrically coiled shape, and which extends in an axial direction along a central axis; and a contact portion, which extends from one side in the axial direction of the spring portion, and which comprises an arc-shaped portion, which extends along a plane parallel to the central axis of the spring portion, at an end of the spring portion in the axial direction, wherein a radius of curvature of the arc-shaped portion is larger than a radius of the spring portion.

16. The electrode member according to claim 15, wherein the contact portion comprises a wire, and wherein the contact portion is wound the wire twice or more.

* * * * *